US006241246B1

(12) United States Patent
Guttin et al.

(10) Patent No.: US 6,241,246 B1
(45) Date of Patent: Jun. 5, 2001

(54) LOTTERY TICKET AND WORD GAME PLAYED THEREBY

(75) Inventors: Susan Guttin, Cambridge (CA); Carla Schaefer, San Antonio, TX (US)

(73) Assignee: Oberthur Gaming Technologies, Inc., Montreal (CA)

( * ) Notice: Subject to any disclaimer, the term of this patent is extended or adjusted under 35 U.S.C. 154(b) by 0 days.

(21) Appl. No.: 09/417,437

(22) Filed: Oct. 13, 1999

(51) Int. Cl.[7] ..... A63B 71/00

(52) U.S. Cl. ..... 273/139; 273/138.1; 273/272; 273/273; 273/269; 283/901; 283/903

(58) Field of Search ..... 273/139, 138.1, 273/269, 272, 273; 463/17, 10; 283/901, 903

(56) References Cited

U.S. PATENT DOCUMENTS 3,900,219 * 8/1975 D'Amato et al. ..... 273/139
4,740,016 * 4/1988 Konecny et al. ..... 273/139
4,943,090 * 7/1990 Fienberg ..... 273/139
4,953,895 * 9/1990 Goussios ..... 273/139
5,046,737 * 9/1991 Fienberg ..... 273/139
5,074,566 * 12/1991 Desbiens ..... 273/269
5,158,293 * 10/1992 Mullins ..... 273/139
5,193,815 * 3/1993 Pollard ..... 273/269
5,544,881 * 8/1996 Rua, Jr. et al. ..... 273/139
5,560,608 * 10/1996 Silverschotz ..... 273/240
5,772,511 * 6/1998 Smeltzer ..... 463/17
6,076,860 * 6/2000 Holman et al. ..... 273/139

* cited by examiner

*Primary Examiner*—Steven Wong
*Assistant Examiner*—D. Collins
(74) *Attorney, Agent, or Firm*—Watov & Kipnes, P.C.

(57) ABSTRACT

A lottery ticket having a first game area with a grid of target letters arranged so that at least some of the letters form target words and a second game area having a list of preselected game words which are covered by a scratch-off layer. The game words are matched with the target words to determine if a prize has been won. An enhanced play action in the form of at least one third game area may be provided.

14 Claims, 5 Drawing Sheets

LOTTERY TICKET AND WORD GAME PLAYED THEREBY

FIELD OF THE INVENTION

The present invention is directed to a lottery ticket based on chance which provides for the matching of a preselected list of words with words which appear in a game area such that if preselected words are matched with words appearing in a game area a prize may be won according to the number of matches made. The player has the option of locating the preselected words in the game area to enhance the enjoyment of playing the lottery ticket.

BACKGROUND OF THE INVENTION

A common and enjoyable puzzle that has appeared in puzzle magazines and newspapers over the years provides a grid of what appears to be random letters. The player must look through the grid of letters to find words, typically having a minimum of three letters. Such word puzzles are enjoyed by numerous individuals and are played as a form of amusement.

Scratch-off lottery tickets are common in the lottery industry. Game data is covered by a scratch-off layer and when the scratch-off layer is removed the game data is exposed. In typical scratch-off lottery tickets a grid of game symbols is covered by a scratch-off layer. Once the scratch-off layer is removed, if the game symbols provide a certain pattern (e.g. three of the same symbol) the player may win a prize. Thus, the typical scratch-off lottery tickets require the player to remove the scratch-off layer and immediately determine if a prize has been won.

It is desirable in the scratch-off lottery industry to provide lottery tickets which not only provide the opportunity to win a prize but also to provide the opportunity to play a game which adds to the value and the enjoyment of the lottery ticket itself. It would therefore be a significant advance in the scratch-off lottery ticket industry to provide a lottery ticket game which can provide the opportunity to look for words in a maze of letters contained within a grid and at the same time to play a lottery game wherein the number of preselected words which appear in the grid are indicative of the type of prize that may be won.

SUMMARY OF THE INVENTION

The present invention is generally directed to a lottery ticket employing a word puzzle game of chance in which the player is provided with a preselected list of words up to all of which may appear in a grid of letters constituting part of a game area. The greater number of preselected words that appear in the game area, the more likely a prize will be won and the higher the prize value.

In a particular aspect of the present invention, there is provided a lottery ticket comprising a substrate having thereon:

a) a first game area comprised of a grid of target letters arranged so that at least some of the letters form target words;

b) a second game area comprised of a list of a plurality of game words each game word covered by a scratch-off layer; and c) prize determining means for determining whether a prize is won and the value of the prize based on the number of game words which appear as target words in the first game area.

In an alternative form of the invention, there is provided at least one enhanced play action or game which provides the player with an additional opportunity to have a winning ticket and/or to increase the value of a winning prize. Such enhanced play actions or games include, for example, the use of a bonus word or symbol which can provide a separate prize or increase the value of the prize of an already winning ticket.

In a further form of the present invention, the target letters are covered with a scratch-off layer in a manner which enables the players to mark each of the target letters that form game words so that the game words can be readily observed within the grid of target letters. This embodiment of the present invention facilitates the player's option of locating and marking the preselected words in the game area.

BRIEF DESCRIPTION OF THE DRAWINGS

The following drawings in which like reference characters indicate like parts are illustrative of embodiments of the invention and are not intended to limit the invention as encompassed by the claims forming part of the application.

DETAILED DESCRIPTION OF THE INVENTION

The present invention is generally directed to a lottery ticket which employs a word puzzle game in which a preselected set of words referred to herein as "game words" are matched with target words which appear in a grid comprised of a maze of letters. If a sufficient number of preselected game words match target words then a prize may be won. In order to be eligible for a prize, the player must have a minimum number of target words (e.g. three words) which match the preselected game words. In an embodiment of the invention, the player may locate and mark the preselected game words by removing the scratch-off layer which covers the same. This provides an enhancement of the lottery ticket by which the player actually searches for the target words.

Figure 1:
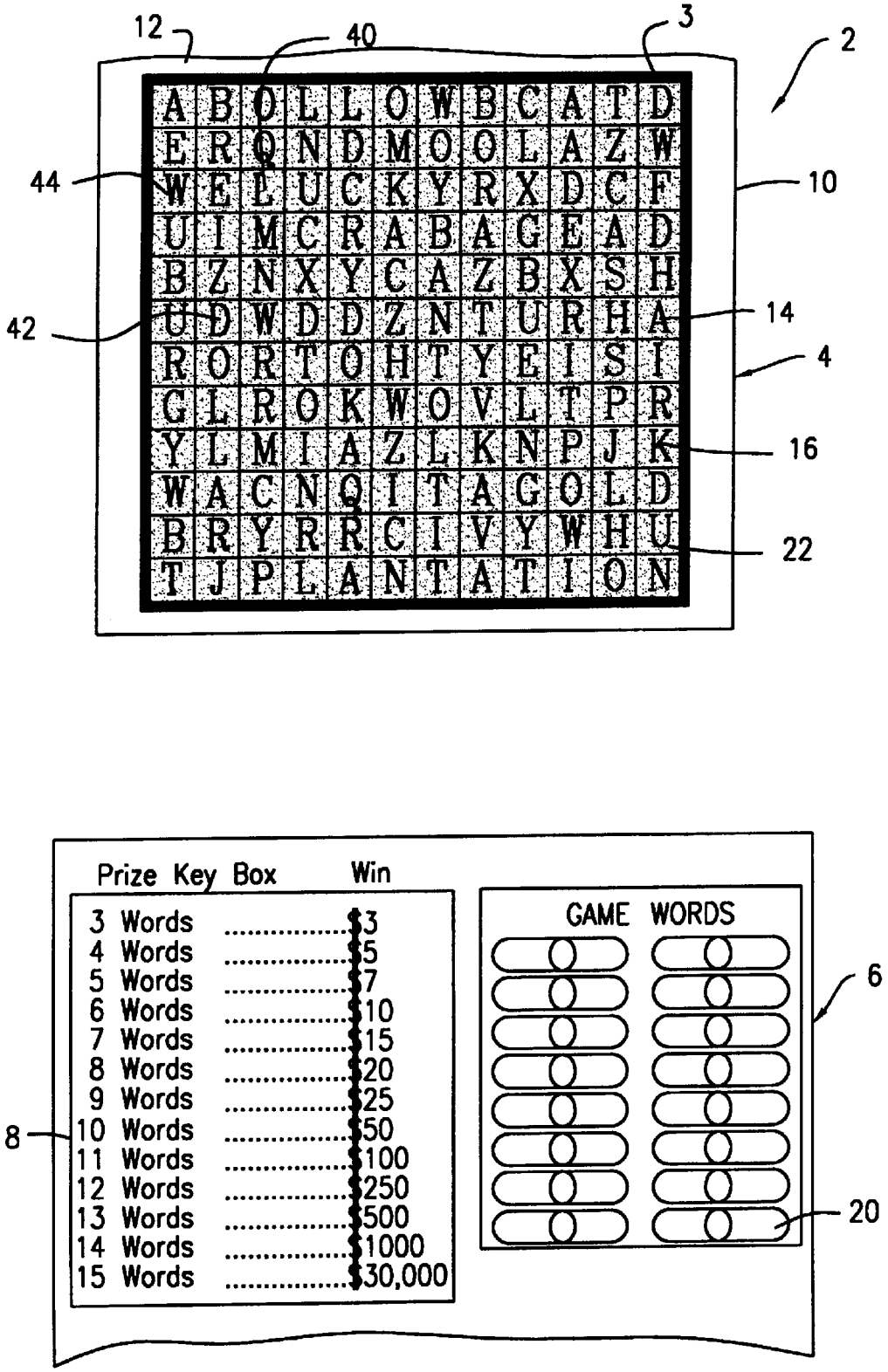
FIG. 1 is a perspective view of an embodiment of the front face of the lottery ticket in accordance with the present invention.

Referring specifically to FIG. 1, there is disclosed the front face 3 of a lottery ticket 2 which includes a first game area 4, a second game area 6 and a prize determining area 8 which determines whether a prize has been won based on the play action of the game as hereinafter described.

The first game area 4 is comprised of a grid of seemingly randomly selected letters. The grid is preferably in the form of a plurality of rows 10 and columns 12 with each row and column containing a plurality of boxes 14, preferably at least three boxes with each box containing a letter 16. While the arrangement of letters appearing in the respective boxes 14 may appear random, certain groupings of letters may form words. The groupings may be established according to the rules of the game. By way of example, and as shown specifically in FIG. 1, the groupings occur either in a row 10 or in a column 12 or in a diagonal covering multiple rows and/or columns. More specifically, in the third row from the top of the first game area 4 is the word "Lucky" identified by the numeral 40. In the second column from the left there appears the word "Dollar" identified by the numeral 42. The word "Window" (identified by the numeral 44) begins diagonally from the left most column, third row. Other words appear in the game area 4 as described hereinafter.

The first game area 4 may not be covered by a scratch-off layer in which event the target letters are visible as printed on the front face 3 of the lottery ticket 2. In an alternate form of the invention, the first game area 4 is covered by a scratch-off layer which may be opaque or transparent. The employment of such scratch-off layers enables the player to mark the target words if he or she wishes to engage in the optional play of actually locating the target words.

The opaque scratch-off layer in the first game area 4 may be constructed in accordance with the teachings of Desbiens, U.S. Reissue Pat. No. 34,673, incorporated herein by reference. In this embodiment of the invention, the substrate or a conventional layer applied above the substrate is imprinted with the target letters 16. An opaque scratch-off layer is then applied over the target letters 16 to hide the same from view. Thereafter, at least one overprint layer is applied to the scratch-off layer comprising the same target letters which appear on the substrate. When the scratch-off layer is removed from a particular box 14, the target letter 16 printed on the substrate will then be visible. In this system it is possible to provide the substrate with a different color than the scratch-off layer enabling the player to differentiate between the target letters which appear after removal of the scratch-off layer from those that remain on the scratch-off layer. As a result, the player can more clearly see the target words which correspond to the game words.

Another system for providing contrast between the target letters which form target words corresponding to the game words and the remaining letters of the first game area, is through the use of a transparent, optionally colored scratch-off layer. Such a system is described in U.S. Pat. No. 6,076,860 issued on Jun. 20, 2000, incorporated herein by reference.

In one such system a clear transparent scratch-off layer is provided over the target letters printed on the substrate. Because the scratch-off layer is transparent, it is not necessary to overprint the target letters on the scratch-off layer. The player can see through the scratch-off layer and thereby see the target letters. The player can remove the portion of the scratch-off layer which covers the target words and thus distinguish the target words from the remaining target letters.

In another such system the transparent layer may be provided with a color or a transparent colored layer may be printed over the scratch-off layer so long as both the scratch-off layer and optional colored layer may be removed by the player. When the scratch-off layer is removed, the target letter appears with a different colored background than the color of the scratch-off layer. This system enables the player to readily differentiate the target words from the remaining target letters.

A second game area 6 is provided which contains a preselected list of words 18 (see FIG. 2) which is typically and preferably covered by a scratch-off layer 20 as shown in FIG. 1.

It will be understood that the lottery game may be played in accordance with the present invention as a game of chance. In this event, a winning ticket may be had even if a player does not actually match the words or even remove the scratch-off layer. All that is required is that the number of matches be determinable by a representative of the sponsor of the lottery game (e.g. a lottery retail agent) or the lottery itself. It is likely, however, that most players will want to expose the preselected list of words, match the preselected words with target words, and determine if a prize has been won.

Figure 2:
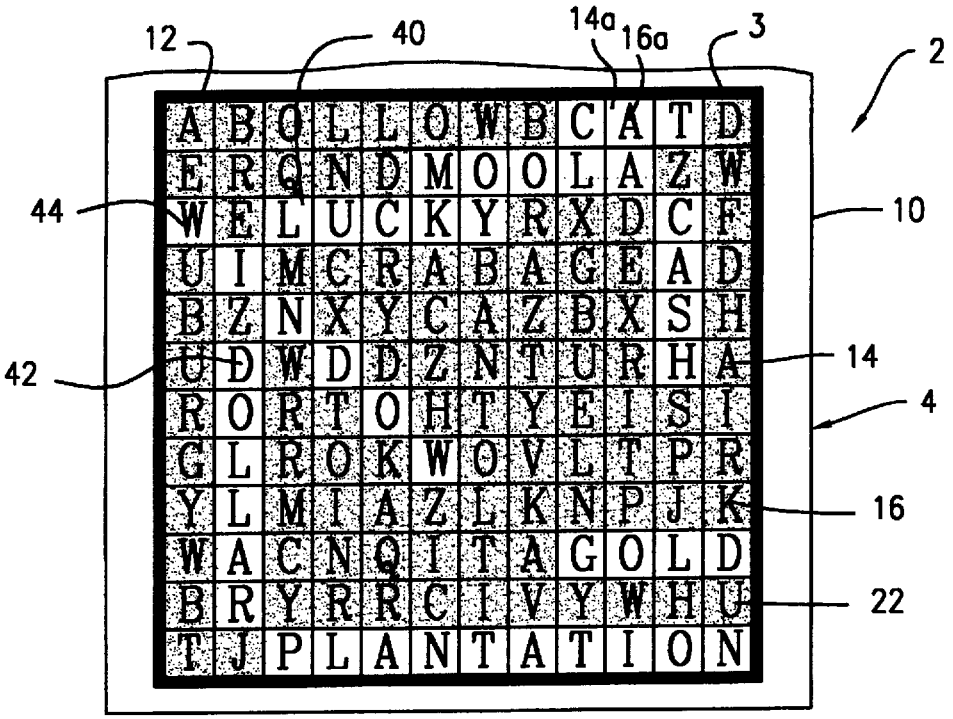
FIG. 2 is a perspective view similar to FIG. 1 and constitutes a preferred embodiment in which the game words have been exposed and corresponding target words have been located in the first game area by a scratch-off layer covering the appropriate target letters.
Figure 2:
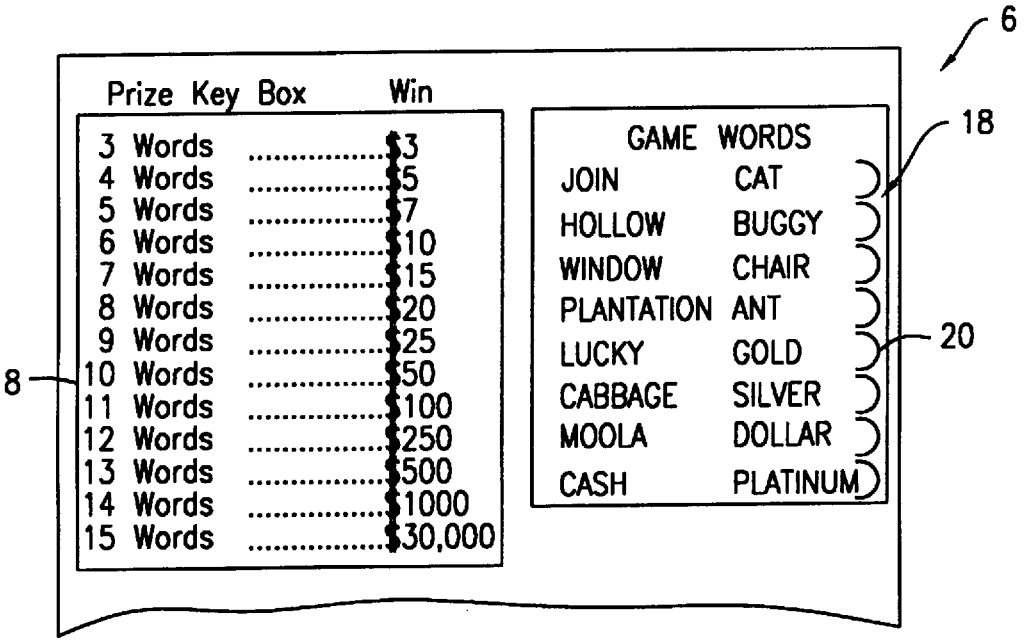
Figure 3:
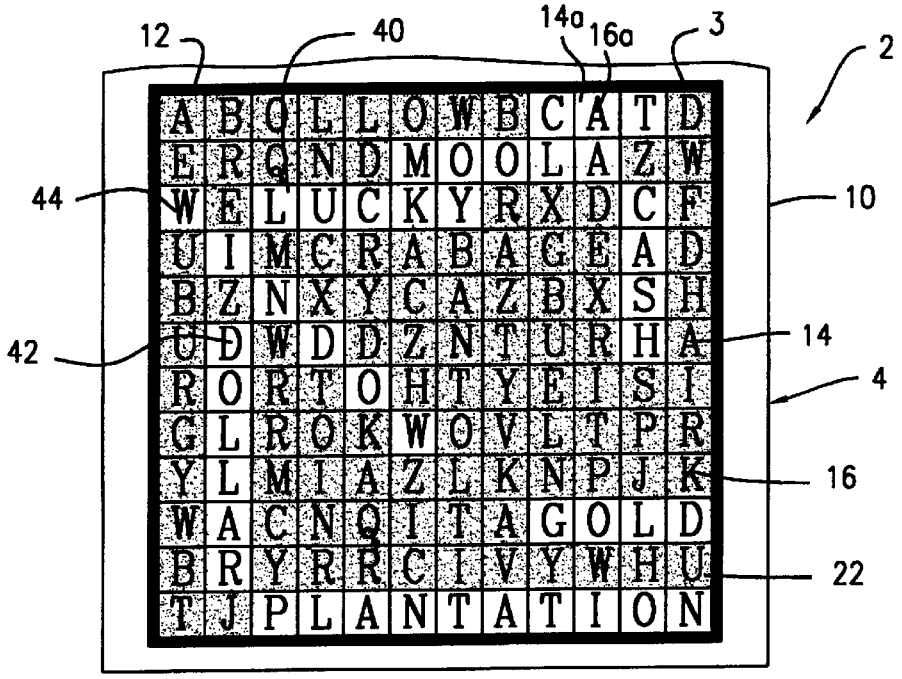
FIG. 3 is a perspective view similar to FIG. 2 showing one third game area for playing an embodiment of an enhanced play action.
Figure 3:
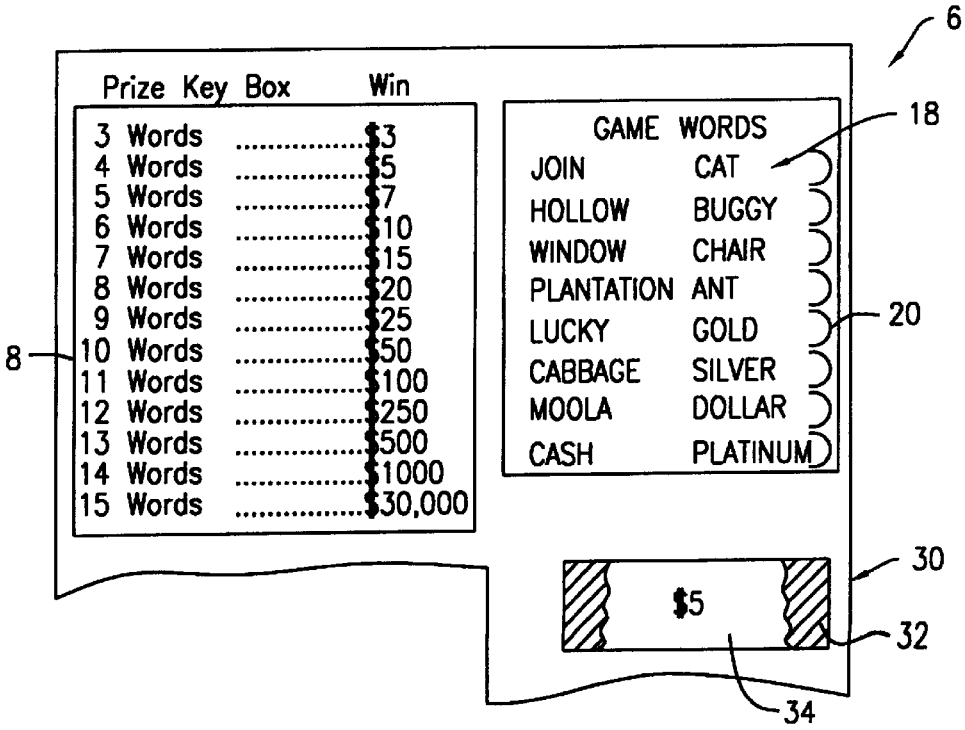

FIGS. 2 and 3 show the remnants of the scratch-off layer 20 after enough of the scratch-off layer has been removed to reveal the preselected words 18. It will be noted that, for security reasons, at least one of the first game area 4 and the second game area 6 must be covered by a scratch-off layer. In the preferred form of the invention, the second game area is covered by the scratch-off layer 20 as shown in FIG. 1. In a more preferred embodiment, the first game area 4 is also covered by either a transparent or opaque scratch-off layer as previously described to assist the player if he or she discloses to locate and mark the target words. As explained in detail hereinafter, when the scratch-off layer 20 is removed, the preselected list of game words is uncovered and a determination can be made if a prize has been won and the value of the prize.

Referring again to FIG. 1, there is arranged on the lottery ticket 2 a prize determining area 8 which provides a listing of the number of matches between the game words and the target words and for each number of matches a predetermined prize value (e.g. for three matches a $3 prize is won).

The lottery game in accordance with the present invention may be played by removing the scratch-off layer 20 to expose the preselected list of game words 18 in the second game area 6 as shown best in FIG. 2. One or more of the game words appearing in the preselected list of words 18 in the second game area 6 may also appear as target words in the first game area 4. Thus, the word "Cat" appearing in the preselected list of words 18 has a match in the first row of the first game area 4. If the lottery ticket has at least a minimum number of matches of game words and target words, the prize determining area 8 provides the information needed to determine if a prize will be won. The more matches the greater the prize value.

Once a determination has been made that the game word "Cat" listed in the second game area 6 appears or does not appear as a target word in the first game area 4, then the player goes to the next word (e.g. "Join") and searches for that word in the first game area 4. Since this word is not within the first game area 4, there is no match.

The player proceeds to go through all of the game words and determine how many matches are made with the target words appearing in the first game area 4. Once the number of matches has been determined, the player proceeds to the prize to determining area 8 and determines if the minimum number of matches have been made (e.g. 3) and, if so, how many matches have been made along with the prize amount for that number of matches.

The player may indicate in the first game area 4 the target words which match the words contained in the preselected list of words 18 by employing a pencil, pen or marker or other marking systems. Alternatively and in one aspect of the present invention, the lottery ticket itself may be provided with a system employing an opaque or transparent scratch-off layer as previously described. Such systems enable a player who chooses to locate the target words, to mark each word by removing the scratch-off layer 22 from the target letters which form the target word, and visibly differentiate the target word from the remaining target letters as shown best in FIGS. 2 and 3. For example, the employment of a transparent scratch-off layer 22 may provide a different color than the background layer appearing on the substrate. Referring to FIG. 2, when the scratch-off layer 22 is removed from a particular box 14*a* containing a target letter 16*a,* the visual appearance of the box 14*a* will be different than the remaining boxes 14 which have not had the scratch-off layer removed.

In a further embodiment of the present invention, the lottery ticket is provided with an enhanced play action which means that an additional game playing procedure is available to the player to offer him or her the opportunity to win an additional prize and/or enhance the value of a prize already won.

Enhanced play action in accordance with the present invention can be established in a variety of ways. The enhanced play action may be a stand alone or independent play action or may be a play action which is interactive with the word game described previously in connection with game areas 4 and 6. The stand alone and interactive enhanced play actions generally require the player to remove a scratch-off layer from at least one separate game area to uncover at least one symbol. The presence of a particular symbol may result in a winning prize in accordance with the rules of the game.

An example of a stand alone enhanced play action is shown in FIG. 3. There is provided a single third game area 30 which may contain at least one symbol which itself is indicative of a prize being won. It will be understood that more than one third game area 30 may be employed. As shown specifically in FIG. 3 the third game area 30 is covered by an opaque scratch-off layer 32, which when removed may reveal a symbol 34 indicative of a prize (e.g. $5). The presence or absence of a symbol 34 and the type of prize that may be won thereby is independent of the game played in conjunction with game areas 4 and 6.

It will be appreciated that the symbols 34 can vary widely including words, letters, numbers, icons and the like which may be directly indicative of a prize and the amount thereof or may be used in conjunction with additional instructions provided on the ticket to enable the player to determine if a separate prize has been won.

The enhanced play action may comprise an interactive play action in which the third game area and symbols employed therein are used in conjunction with the game areas 4 and 6 to possibly provide an additional prize for the player and/or to enhance the value of an already existing prize.

Figure 4:
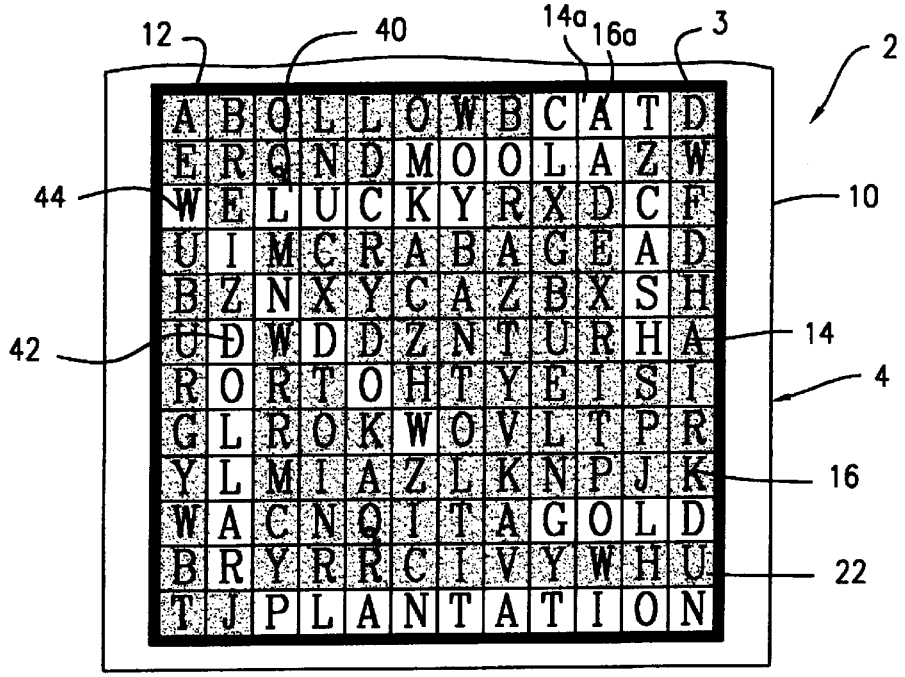
FIG. 4 is a perspective view similar to FIG. 3 showing one third game area for playing a further embodiment of an enhanced play action.
Figure 4:
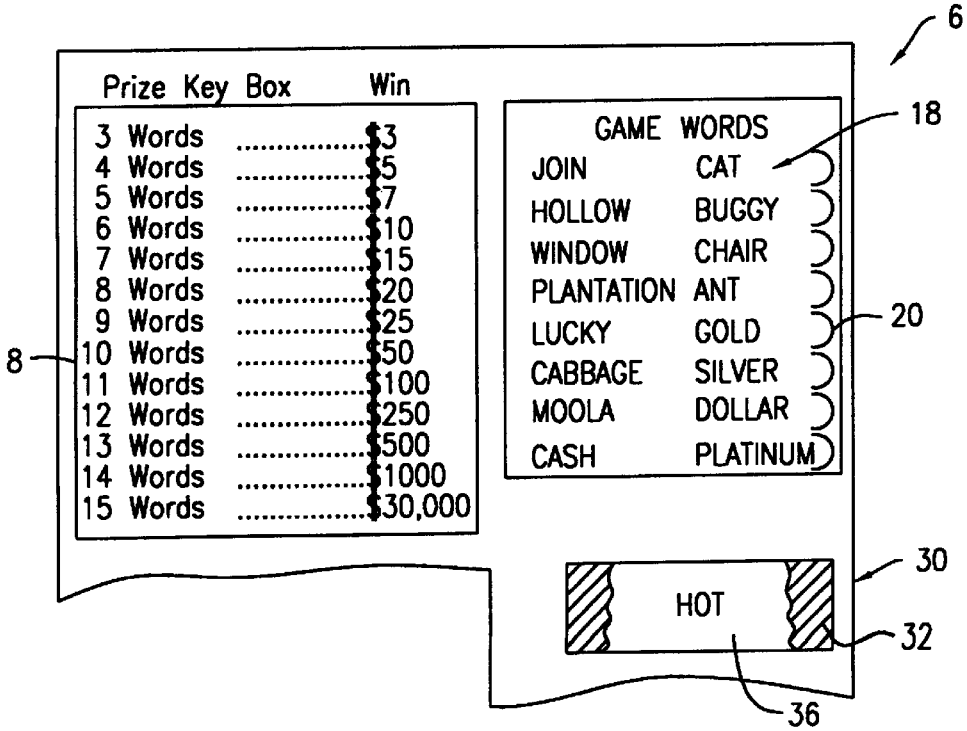

Referring to FIG. 4 there is shown a lottery ticket in accordance with the present invention employing, for example, a single third game area 30 in which the symbol contained therein is interactive in that it is played in conjunction with game areas 4 and 6. As shown in FIG. 4, the game area 30 is initially covered by an opaque scratch-off layer 32, which when removed as described in connection with the embodiment of FIG. 3 reveals a game symbol 36. The game symbol 36 may be at least one game word (i.e. the word "HOT" is specifically shown). According to the rules of the interactive enhanced play action, for example, the game symbol 36 may be a word which serves the same purpose as preselected game words 18. If the game word 36 in the third game area 30 appears as a target word in the first game area 4, a separate prize may be awarded and/or the value of the prize already won may be increased, or the player may be awarded a prize of higher value because the number of "matches" in the first game area has increased.

In another embodiment, the interactive form of the enhanced play action may include use of a game symbol 36 in the form of a word which directly affects the value of an already winning ticket. Such words in this embodiment of the invention include, for example, "Double", "Triple", variations thereof and the like. These words, while not adding to the number of matches between target words and preselected game words, nonetheless may increase the value of a winning ticket such as by doubling the prize winning value of four matches from $5 to $10.

Figure 5:
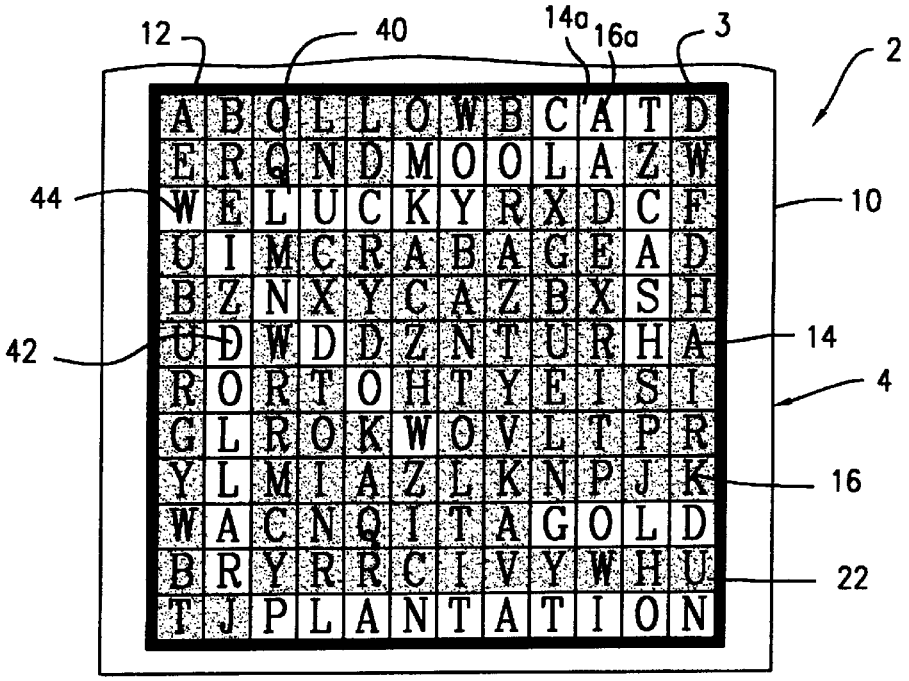
FIG. 5 is a perspective view similar to FIG. 3 showing two third game areas for playing a further embodiment of an enhanced play action.
Figure 5:
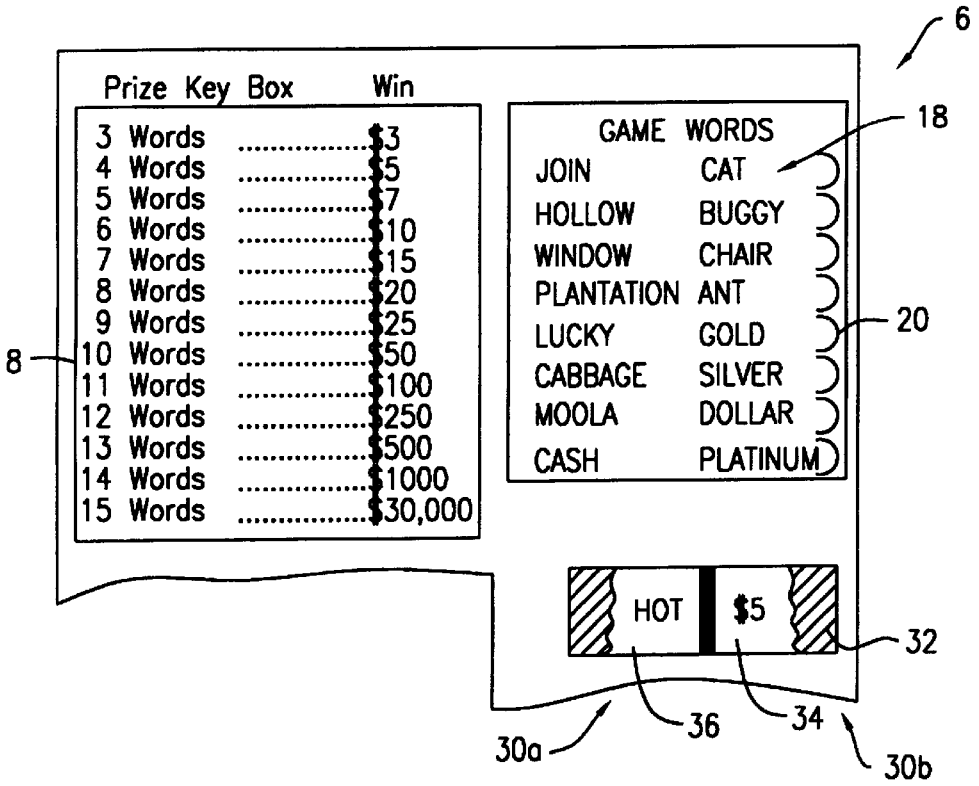

It will be understood that more than one third game area 30 may be employed to provide multiple bonus play actions. As shown in FIG. 5, two third game areas 30*a* and 30*b* each containing a separate game symbol 34, 36, respectively are shown. In the embodiment specifically shown in FIG. 5 game symbol 36 is a preselected word which may be matched with a target word to increase the number of matches. The game symbol 34 is for a specific prize separate from the number of matches appearing on the ticket.

It will be further understood that the arrangement of letters in the first game area 4 can vary. Although a grid containing rows and columns is a convenient way of displaying the letters, other versions are within the spirit and scope of the present invention including circular arrangements of letters. Furthermore, the number of words appearing in the preselected list of words may vary as well as the size and number of letters contained within the first game area. In addition, in one embodiment of the invention, different values may be placed on the matching of different words such that matching, for example, a five letter target word and preselected game word produces a greater value (e.g. counts as two matches) than the matching of a three letter word. Other variations of the present invention would be apparent to those of ordinary skill in the art.

As described above, when the lottery game is played as a game of chance standard lottery ticket readers or the retail agent per se, can determine if a) a prize should be awarded from the standard play and the bonus play (even in the absence of direct participation by the player) and b) if the lottery ticket is valid. If the player chooses to do so, the player may remove the scratch-off layer from the preselected game words 18 and appropriate portions of the scratch-off layer from the first game area 4 to locate and mark the target words which have been matched with preselected game words to provide an optional form of entertainment. In addition, the player may optionally remove the scratch-off layer from the third game area to determine if a bonus prize should be awarded before such determination is made by the lottery game authority.

What is claimed is:

1. A lottery ticket comprising a substrate having thereon:

a) a first game area comprised of a grid of target letters arranged so that at least some of the letters are arranged in a group to form target words;

b) a second game area comprised of a list of a plurality of game words each game word covered by a scratch-off layer wherein up to all of the game words are present as target words in the first game area; and c) prize determining means for determining a prize based on the number of game words which appear as target words in the first game area.

2. The lottery ticket of claim 1 wherein the first game area is covered by a scratch-off layer.

3. The lottery ticket of claim 2 wherein the scratch-off layer is transparent.

4. The lottery ticket of claim 2 wherein the scratch-off layer is opaque, said lottery ticket further comprising an overprint layer over the scratch-off layer including a second grid of identical target letters.

5. The lottery ticket of claim 1 wherein the first game area is arranged in a plurality of rows and columns containing a plurality of boxes with each box containing a target letter.

6. The lottery ticket of claim 2 wherein the target words are formed by combining target letters in a column, in a row, or in a diagonal line.

7. The lottery ticket of claim 3 wherein the minimum number of target letters to form a target word is three.

8. The lottery ticket of claim 1 wherein the prized determining means comprises a chart, said chart including a list of the number of target words which are matched by game words and a prize for matching at least a minimum number of game words and target words.

9. The lottery ticket of claim 1 further comprising an enhanced play action in the form of at least one third game area.

10. The lottery ticket of claim 1 wherein the third game area may include at least one game symbol which may result in a prize being won or an increase in the value of a prize already won.

11. The lottery ticket of claim 10 wherein the third game area may include a game word which may appear as a target word in the first game area.

12. The lottery ticket of claim 10 wherein the third game area may include a game symbol which increases the value of a prize already won.

13. The lottery ticket of claim 10 wherein the at least one game symbol is covered by a scratch-off layer which is removable by the player.

14. The lottery ticket of claim 1 wherein less than all of the game words appearing in the second game area appear as target words in the first game area.

* * * * *